US005392963A

United States Patent [19]

Kelly et al.

[11] Patent Number: 5,392,963

[45] Date of Patent: Feb. 28, 1995

[54] REFURBISHED TONER CARTRIDGE

[75] Inventors: Gar P. Kelly; Brian J. Renstrom; K. Trent Christensen, all of Boise, Id.

[73] Assignee: Hewlett-Packard Company, Palo Alto, Calif.

[21] Appl. No.: 69,636

[22] Filed: Jun. 1, 1993

[51] Int. Cl.[6] ..... G03G 15/06; G03G 21/00

[52] U.S. Cl. ..... 222/325; 222/386.5; 222/DIG. 1; 355/260

[58] Field of Search ..... 222/DIG. 1, 94, 541, 222/386.5, 542; 355/3 R, 3 DD, 14 R, 8, 260; 141/364, 18, 84, 98

[56] References Cited

U.S. PATENT DOCUMENTS

| | | | |
|---|---|---|---|
| 2,608,320 | 8/1952 | Harrison, Jr. | 222/386.5 X |
| 3,501,065 | 3/1970 | Altmann et al. | 222/DIG. 1 X |
| 4,013,195 | 3/1977 | Ferris | 222/386.5 X |
| 4,417,802 | 11/1983 | Forbes, II | 222/386.5 X |
| 4,489,765 | 12/1984 | Yamada et al. | 222/DIG. 1 X |
| 4,732,277 | 3/1988 | Smith | 222/DIG. 1 X |
| 4,895,104 | 1/1990 | Yoshino et al. | 222/DIG. 1 X |
| 5,142,335 | 8/1992 | Sakata et al. | 222/DIG. 1 X |
| 5,148,223 | 9/1992 | Cipolla | 222/DIG. 1 X |
| 5,150,807 | 9/1992 | Seyfried et al. | 222/DIG. 1 X |
| 5,153,650 | 10/1992 | Maeshima | 222/DIG. 1 X |
| 5,177,540 | 1/1993 | Honda et al. | 222/DIG. 1 X |
| 5,194,900 | 3/1993 | Hagihara et al. | 222/DIG. 1 X |
| 5,207,353 | 5/1993 | Corby et al. | 222/325 X |
| 5,235,389 | 8/1993 | Kikuchi et al. | 222/DIG. 1 X |
| 5,271,534 | 12/1993 | Fillmore et al. | 222/386.5 X |
| 5,311,265 | 5/1994 | Miller | 222/DIG. 1 X |
| 5,335,831 | 8/1994 | Foster | 222/DIG. 1 X |
| 5,337,126 | 8/1994 | Michlin | 222/DIG. 1 X |

*Primary Examiner*—Andres Kashnikow
*Assistant Examiner*—Kenneth DeRosa

[57] ABSTRACT

A refurbished toner cartridge includes a cover having elongated side dimensions with integral flanges and a mating bottle also having elongated side flanges, the flanges bonded to create an interior volume for holding a print toner. At one end of the cartridge is a toner fill opening which enables access into the interior volume. The refurbished cartridge further comprises a flexible bladder that is inserted through the fill opening and is positioned within the interior volume of the cartridge. Toner is contained in the bladder and is released upon the bladder being ruptured by user actuation of either an internal knife blade or a pull string attached to the bladder.

11 Claims, 4 Drawing Sheets

REFURBISHED TONER CARTRIDGE

FIELD OF THE INVENTION

This invention relates to replaceable toner cartridges for use with electrostatic printers and copiers and, more particularly, to methods and apparatus for enabling reuse of used toner cartridges.

BACKGROUND OF THE INVENTION

Laser printers and electrostatic copiers employ toner cartridges that contain a supply of toner material for use during the electrostatic development process. The cartridges are designed to be replaced from time to time, to replenish the toner that is used during the printing process. Such toner cartridges include an elongated toner container (called a "bottle") and a cover that includes a charging rod and an electrostatic magnetic roller assembly. The bottle and cover have flanges that mate and are bonded along their elongated dimensions to create a singular cartridge structure. At one end of the cartridge, the flanges are not bonded, but rather include a foam seal through which a toner "dam" tear strip extends. When the toner cartridge is first used, the tear strip is removed by pulling it through the foam seal, thereby causing removal of an internal dam that covers the bottle portion of the cartridge, thereby rendering accessible the toner contained therein.

While toner cartridges were initially designed to be discarded after the original toner supply was exhausted, certain cartridge portions, (i.e., the magnetic roller and charging rod) have longer useful lives. Thus, a market has developed for refurbished cartridges that have been refilled with a supply of toner. However, replacement toner dams have generally been unsatisfactory as they have enabled leakage of refilled toner.

In copending U.S. application Ser. No. 08/071,909 entitled "TONER CARTRIDGE TONER DAM REPLACEMENT AND METHOD THEREFOR", a plurality of improved toner dams and methods for their insertion into used toner cartridges are disclosed. U.S. Pat. No. 5,080,745 to Paull also discloses a replacement toner dam for insertion into a used toner cartridge. Each of the toner dams shown in the above noted copending application and in Paull require either the insertion of a replacement toner dam through the above described foam seal in the end of a cartridge or, require disassembly of the cartridge.

All toner cartridges are provided with a fill opening at one end through which toner is initially loaded during manufacture. If a new toner dam could be inserted through the fill opening, the resulting refurbishment procedure would be simplified over that shown in the prior art.

Accordingly, it is an object of this invention to provide a simplified means for refurbishing a used toner cartridge.

It is another object of this invention to provide a method for refurbishing a used toner cartridge wherein a need for replacement of the toner dam is obviated.

It is yet another object of this invention to provide a method for refurbishing a used toner cartridge, which method is both simple and inexpensive.

SUMMARY OF THE INVENTION

A refurbished toner cartridge includes a cover having elongated side dimensions with integral flanges and a mating bottle also having elongated side flanges, the flanges bonded to create an interior volume for holding a print toner. At one end of the cartridge is a toner fill opening which enables access into the interior volume. The refurbished cartridge further comprises a flexible bladder that is inserted through the fill opening and is positioned within the interior volume of the cartridge. Toner is contained in the bladder and is released upon the bladder being ruptured by user actuation of either an internal knife blade or a pull string attached to the bladder.

DETAILED DESCRIPTION OF THE INVENTION

Figure 1:
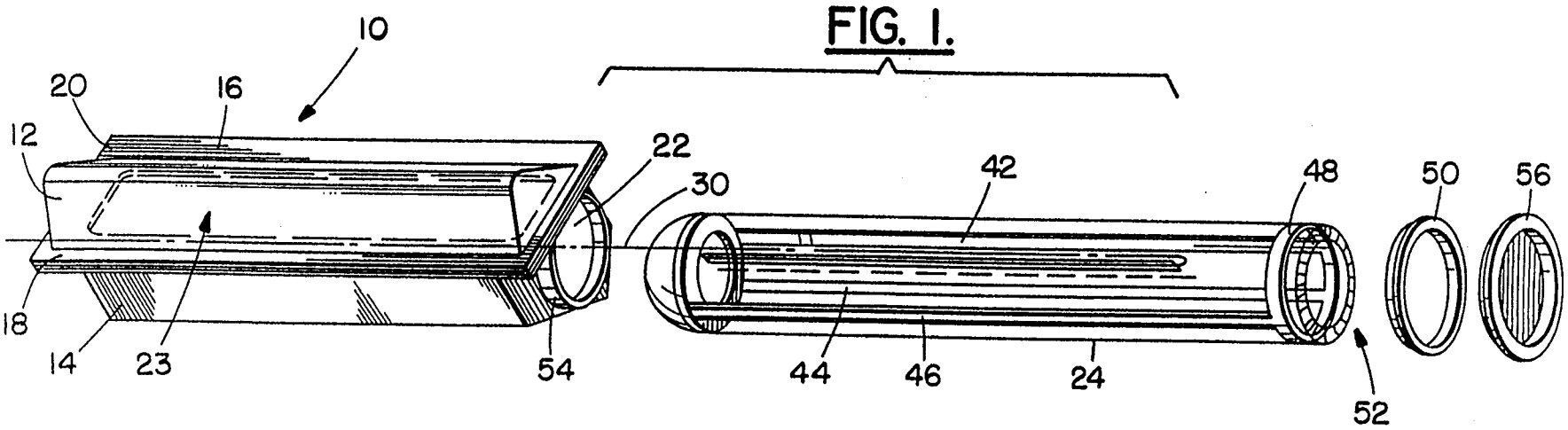
FIG. 1 is an exploded view of a refurbished toner cartridge that incorporates the invention hereof.

Referring to FIG. 1, a used toner cartridge 10 includes a cover 12 and a bottle 14, both of which are provided with abutting flanges 16 and 18 that are bonded to each other. Abutting flanges 20, positioned at one end of toner cartridge 10, are not bonded but rather include (not shown) a foam seal positioned therebetween through which a pull strip was accessed for removal of the original toner dam. At the opposite end of toner cartridge 10, is a fill opening 22 through which toner was originally inserted into the interior volume of toner cartridge 10. Toner cover 12 is drawn in a transparent manner to show communicating opening 23 between cover 12 and bottle 14. A charging rod and magnetic roller assembly positioned in cover 12 are not shown to avoid over-complication of the view.

Figure 3:
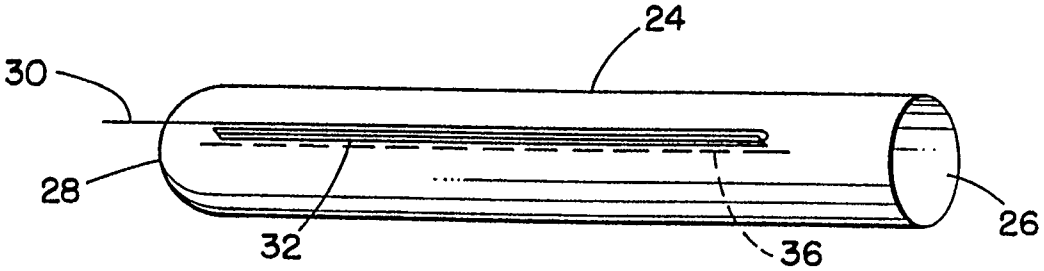
FIG. 3 is a perspective view of the bladder used with the refurbished toner cartridge of FIG. 1.

In FIG. 3, a flexible bladder 24 includes an open end 26 and a closed end 28. A pull string 30 is attached to an adhesive strip 32 that is positioned along a weakened section 36 (shown dashed) in bladder 24. When string 30 is pulled, it causes removal of adhesive strip 32 thereby causing sufficient strain to be placed upon weakened portion 36 to cause it to tear open and expose toner within bladder 24.

Figure 2:
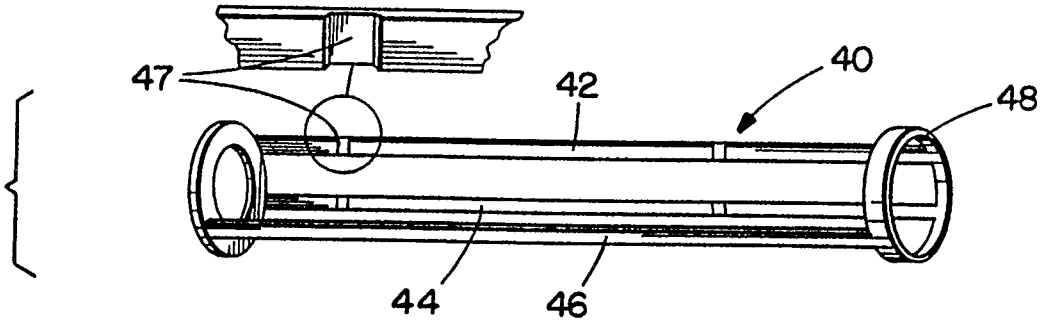
FIG. 2 is a perspective view of a bladder retainer that is used in the refurbished toner cartridge shown in FIG. 1.

Before being inserted in toner cartridge 10, bladder 24 has inserted into its interior, a retainer frame 40 (see FIG. 2). The length of retainer frame 40 is greater than the internal dimensions of bottle 40 so that, upon insertion of frame 40 into bottle 14, frame struts 42, 44 and 46 are put into compression and are bowed outwardly so as to force bladder 24 against the internal surfaces of bottle 14. Weakened sections 47 (shown expanded) assure that the flexure of frame struts 42, 44 and 46 occur in the proper outward direction.

Retainer frame 40 may be fabricated out of any suitable plastic material which exhibits the necessary structural rigidity (e.g., polystyrene). Bladder 24 may be comprised of a rubber composition or a suitable extruded plastic.

As shown in FIG. 1, retainer frame 40 is positioned within bladder 24 and the open end 26 of bladder 24 is folded over frame section 48. String 30 is passed through opening 22 where it may be grabbed by an implement passed through the foam seal opening at end 20 of cartridge 10. String 30 is then drawn through the opening at end 20 and retainer frame 40 and bladder 24 are inserted through opening 22 into the interior of cartridge 10. A snap clip 50 is then inserted into end opening 52 of the retainer frame/bladder combination, thereby forcing the outer circumference of bladder 24 that overlays frame section 48 against the interior of circular flange member 54. Snap clip 50 maintains the folded-over portions of bladder 24 in place on frame section 48. Next, a plug 56 is inserted into snap ring 50, sealing the toner which had been previously loaded into bladder 24. Snap clip 50 and cover 56 act both to seal the internal volume of toner cartridge 10 and the internal volume of bladder 24.

Figure 4:
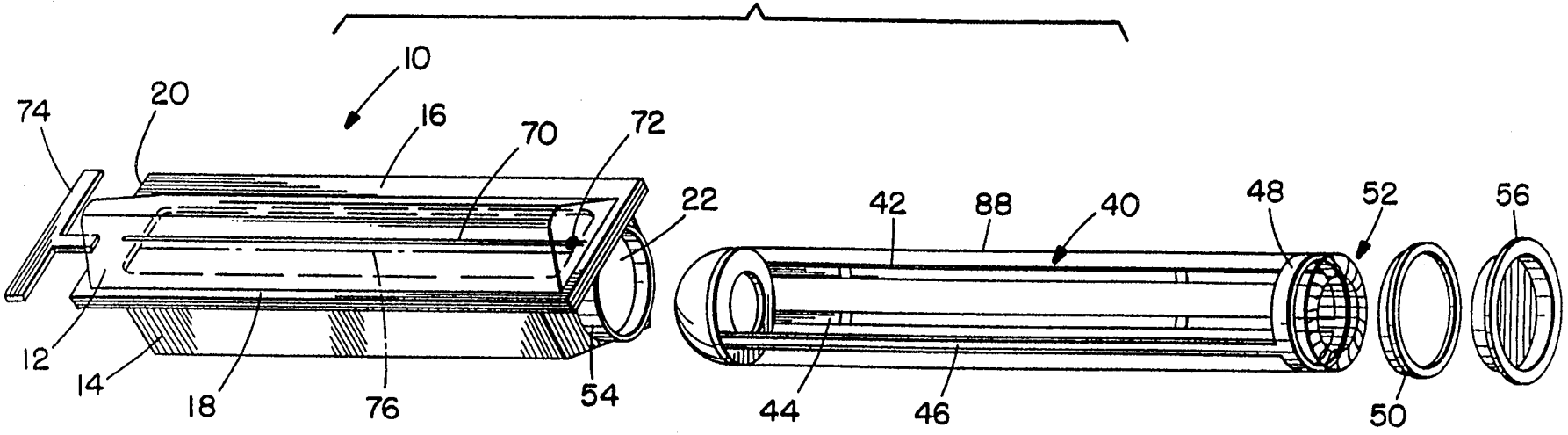
FIG. 4 is an exploded view of a refurbished toner cartridge which employs an internal knife blade to open a toner bladder.
Figure 6:
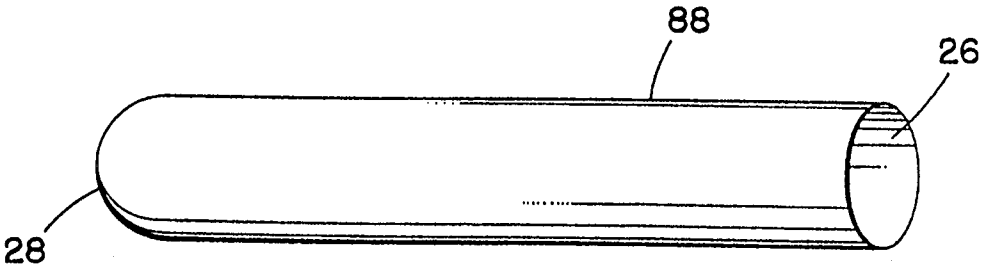
FIG. 6 is a perspective view of the toner bladder used with the refurbished toner cartridge of FIG. 4.
Figure 5:
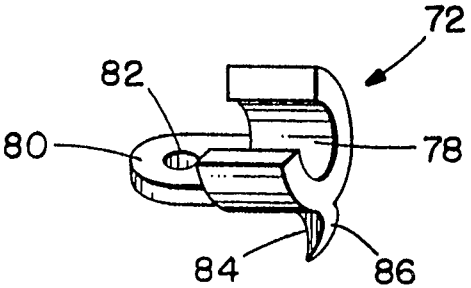
FIG. 5 is a perspective view of the knife blade used with the refurbished toner cartridge of FIG. 4.

Turning to FIGS. 4–6, a further embodiment is illustrated for opening a toner-containing bladder once it is positioned within cartridge 10. Like elements shown in FIGS. 4–6 are numbered identically to those shown in FIGS. 1–3. In FIG. 4, an internal charging rod 70 is shown that is already present in used toner cartridges. A cutting head 72 is positioned on charging rod 70 and is connected to a handle 74 by a rod 76.

An expanded perspective view of cutter 72 is shown in FIG. 5. Cutter 72 is comprised of a molded plastic and exhibits an opening 78 that clips around charging rod 70 to enable travel of cutting head 72 along charging rod 72. An extension 80 includes an opening 82 where rod 76 may be attached. A downwardly extending cutter 84 includes a blunt leading edge 86 which bears against bladder 88 (see FIG. 6) when bladder 88 is inserted through fill opening 22.

After bladder 88 and retainer frame 40 have been inserted into toner cartridge 10 and snap clip 50 and plug 56 are in place, the user withdraws handle 74 causing attached rod 76 to move cutting head 72 to the left. As a result, cutting edge 84 digs into and ruptures bladder 88 thereby enabling escape of toner contained therein. Thereafter, handle 74 can be pushed to the right thereby causing rod 76 to move cutter 72 back to a right most position on charging rod 70.

Figure 7:
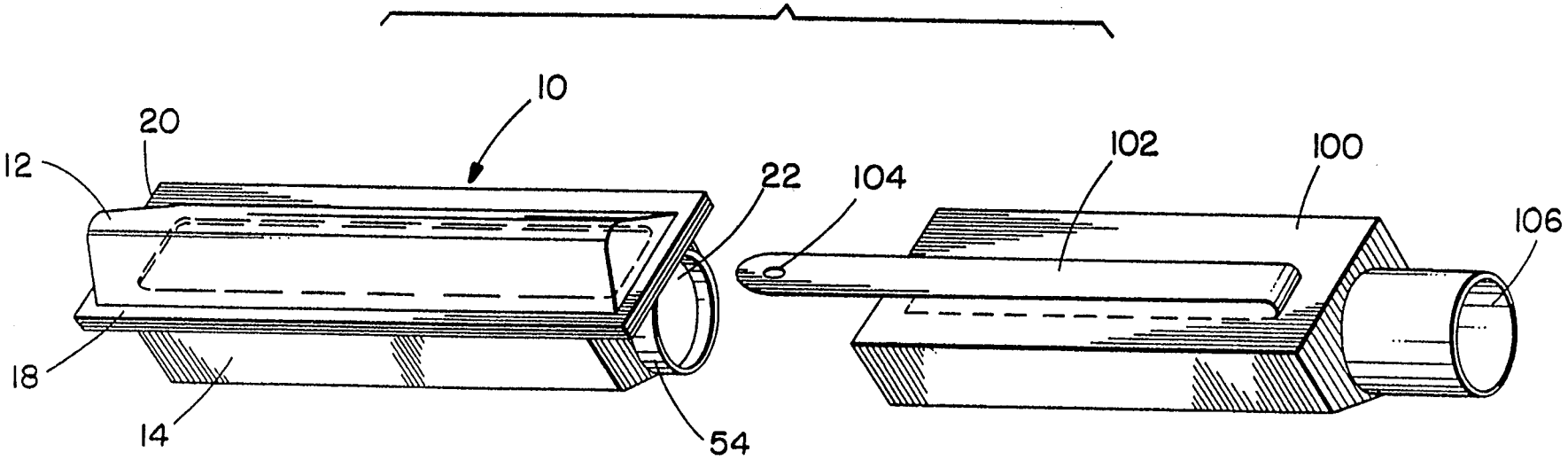
FIG. 7 is an exploded perspective view of a toner cartridge and form-fitting bladder.

In FIG. 7, a preformed bladder 100 is shown that is molded to match the inner dimensions of toner bottle 14. A tear strip 102 is bonded to the upper surface of formed bladder 100 and, when pulled to the left, causes a weakened section of the upper surface of bladder 100 to tear away, thereby exposing the bladder's interior. Formed bladder 100 is inserted into toner cartridge 10 by folding it so that it can be slipped through fill opening 22.

To enable tear strip 102 to be "fished" through the foam seal opening at end 20 of toner cartridge 10, a pair of sandwiched spring steel ribbons are passed through end 20 and out through fill opening 22. There, tear strip 102 is sandwiched between the steel ribbons so that when formed bladder 100 is inserted through fill opening 22, the spring steel ribbons can be simultaneously withdrawn, carrying tear strip 102 through the foam seal opening at end 20.

In lieu of the aforementioned technique, a wire having a hooked end may be passed through the foam seal opening at end 20 and engaged with hole 104 in tear strip 102. Then, when formed bladder 100 is inserted through fill opening 22, withdrawal of the wire will drag tear strip 102 through the foam seal at end 20.

Figure 8:
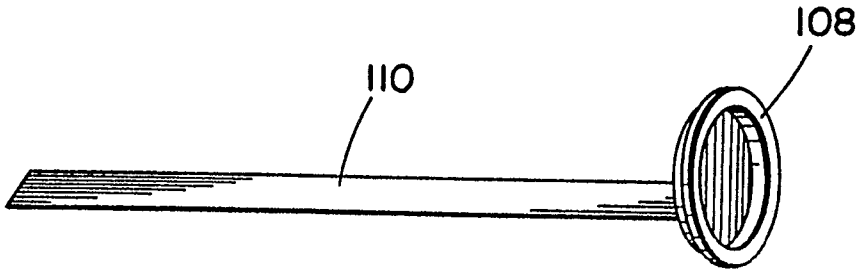
FIG. 8 is a perspective view of a filler cap and retaining rod.

Once formed bladder 100 is inserted into toner cartridge 10, a vacuum may be applied to cause the bladder to expand into a fully open position within toner cartridge 10. Thereafter, formed bladder 100 is filled with toner and a plug 108 (FIG. 8) having an extended post 110 is inserted into opening 106. Post 110 prevents the collapse of formed bladder 100 as the toner becomes exhausted.

In FIGS. 9–13 a further embodiment of the invention is illustrated which enables a toner bladder to be prefilled at a toner factory. A cartridge recycler then only needs to handle toner cartridges and sealed toner bladders, avoiding the need to duplicate toner handling facilities.

Figure 9:
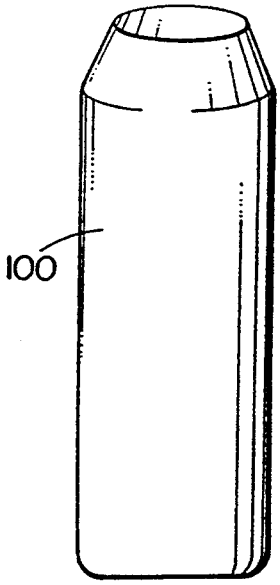
FIG. 9 is a view of a toner bladder that is adapted to be filled with toner prior to insertion in a toner cartridge.
Figure 10:
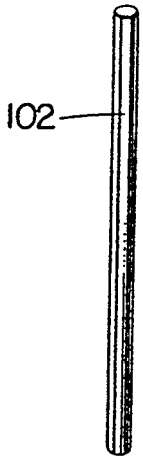
FIG. 10 is a retainer bar for insertion into the toner bladder of FIG. 9.
Figure 11:
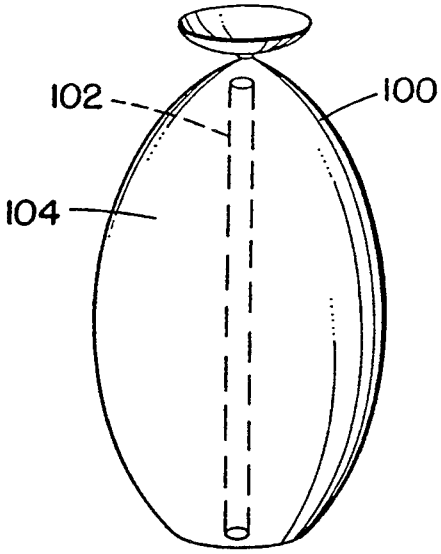
FIG. 11 is a view of the toner bladder of FIG. 9 after it has been filled with toner and a retainer bar.
Figure 12:
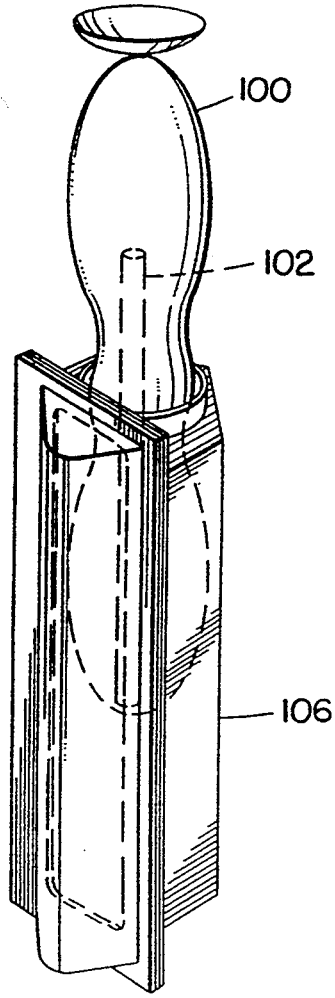
FIG. 12 illustrates the procedure by which a filled toner bladder is inserted into a toner cartridge.
Figure 13:
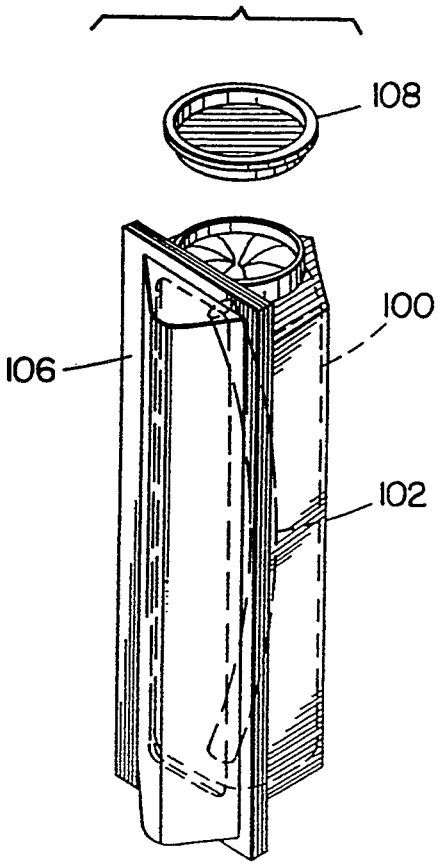
FIG. 13 illustrates the toner cartridge after insertion of the toner bladder and just prior to capping.

The toner bladder 120 of FIG. 9 contains a retainer bar 122 (FIG. 10) and is subsequently filled with toner 124 (FIG. 11). Filled toner bladder 120 is then inserted into the toner fill hole in a toner cartridge 126. Subsequently, a cap 128 is placed on the toner fill hole, causing a flexure of retainer bar 122 that acts to maintain the shape of bladder 120 as toner is used. Toner bladder 120 may be ruptured by an internal cutter as shown in FIG. 5 or by other means as taught hereinabove.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A refurbished toner cartridge including a joined cover and bottle which, together, define an interior volume for said toner cartridge, said toner cartridge having an elongated dimension and further comprising:

a flexible bladder positioned within said interior volume and containing toner; and opening means passing from within said toner cartridge to outside said toner cartridge and cooperating with said flexible bladder and operable by a user from outside said toner cartridge, said opening means movable by said user in a direction of said elongated dimension so as to create an opening in said flexible bladder to enable escape of said toner into said interior volume.

2. The refurbished toner cartridge as recited in claim 1 further comprising:

frame means positioned within said flexible bladder for maintaining said flexible bladder in a non-collapsed configuration.

3. A refurbished toner cartridge as recited in claim 2 wherein said frame means includes flexible elongated frame struts positioned between first and second ring-shaped ends, and wherein an elongated dimension of said frame means exceeds an elongated dimension of said interior volume, said frame means compressed by end walls of said bottle when inserted into said interior volume, said flexible elongated frame struts thereby bowed outwardly towards bounding sides of said interior volume.

4. The refurbished toner cartridge as recited in claim 3 wherein a flanged aperture is formed into an end of said bottle, said flexible bladder and frame means being insertable through said flanged aperture into said interior volume, an open end of said flexible bladder being folded over an opening in a ring-shaped end of said frame means and held in place against said ring-shaped end by ring clip means which fits within said opening of said frame means and bears against said folded over flexible bladder.

5. The refurbished toner cartridge as recited in claim 4 wherein, when said frame means is positioned within said interior volume, said first-ring shaped end of said frame means bears against a wall of said interior volume that opposes said flanged aperture and positions said second ring-shaped end of said frame means in registration with said flanged aperture when said frame means is held in compression, said ring clip means further forcing said second ring-shaped end of said frame means against said flanged aperture so as to maintain said compression of said frame means.

6. The refurbished toner cartridge as recited in claim 5 further comprising a cap which fits within said ring clip means to seal said flexible bladder and said interior volume of said cartridge.

7. The refurbished toner cartridge as recited in claim 1 wherein said opening means comprises a string bonded to a weakened portion of said flexible bladder, said string being accessible to a user outside said toner cartridge and, when pulled, causing a rupture of said weakened portion of said flexible bladder.

8. The refurbished toner cartridge as recited in claim 1 wherein said opening means comprises a cutter blade that is slideably positioned on a rod within said interior volume, said cutter blade further connected to a handle that is positioned external to said toner cartridge, actuation of said handle by a user causing translation of said cutter blade along said rod and a resultant cutting of an opening into said flexible bladder by action of said cutter blade.

9. The refurbished toner cartridge as recited in claim 1 wherein said flexible bladder is preformed to a shape of said interior volume, so that when inserted into said interior volume and expanded, said preformed bladder fills said interior volume, said preformed bladder further provided with a weakened section that is attached to a pull strip, said pull strip being accessible by a user from outside said toner cartridge.

10. The refurbished cartridge as recited in claim 9 wherein said preformed flexible bladder includes an open-end that extends through a flanged opening in said toner cartridge, said opening being sealable by a plug which fits within said flanged opening, said plug having an extended arm that extends into said preformed flexible bladder and prevents collapse thereof upon exhaustion of toner from said bladder.

11. The refurbished toner cartridge as recited in claim 1, wherein said flexible bladder has shape retainer means positioned within said flexible bladder to cause said bladder to remain in an extended configuration as said toner is utilized.

* * * * *